US009803935B2

(12) United States Patent
Kamada et al.

(10) Patent No.: US 9,803,935 B2
(45) Date of Patent: Oct. 31, 2017

(54) HEAT EXCHANGER

(75) Inventors: Toshimitsu Kamada, Sakai (JP); Hirokazu Fujino, Sakai (JP); Shun Yoshioka, Sakai (JP); Aya Okuno, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 259 days.

(21) Appl. No.: 14/117,189

(22) PCT Filed: Apr. 25, 2012

(86) PCT No.: PCT/JP2012/061046

§ 371 (c)(1),
(2), (4) Date: Nov. 12, 2013

(87) PCT Pub. No.: WO2012/157417

PCT Pub. Date: Nov. 22, 2012

(65) Prior Publication Data

US 2014/0224462 A1 Aug. 14, 2014

(30) Foreign Application Priority Data

May 13, 2011 (JP) ..... 2011108594

(51) Int. Cl.
*F28F 1/12* (2006.01)
*F28F 1/02* (2006.01)
(Continued)

(52) U.S. Cl.
CPC ..... *F28F 1/12* (2013.01); *F25D 21/12* (2013.01); *F28F 1/022* (2013.01); *F28F 1/128* (2013.01);
(Continued)

(58) Field of Classification Search
CPC ..... F28D 1/00; F28D 1/02; F28D 1/05366; F28F 1/12; F28F 3/02; F28F 2215/04; F25D 21/12
(Continued)

(56) References Cited

U.S. PATENT DOCUMENTS 4,615,384 A 10/1986 Shimada et al.
4,621,687 A * 11/1986 Ikuta ..... F28D 1/0478 165/152
(Continued)

FOREIGN PATENT DOCUMENTS

JP 57-183482 U 11/1982
JP 59-185992 A 10/1984
(Continued)

OTHER PUBLICATIONS

Machine Translation for KR 20030090467.*
(Continued)

*Primary Examiner* — Len Tran
*Assistant Examiner* — Gustavo Hincapie Serna
(74) *Attorney, Agent, or Firm* — Global IP Counselors, LLP

(57) ABSTRACT

An air-cooled and ventilated heat exchanger includes a fin and a plurality of heat transfer tubes. The fin has a plate-shaped part and a plurality of protruding parts. The plate-shaped part is positioned so that a plate-thickness direction intersects an air-flow direction generated by ventilation, and the protruding parts protrude from the plate-shaped part in the plate-thickness direction. The heat-transfer tubes are-inserted into the fin so as to intersect the air-flow direction. The protruding parts have a first protruding part and a second protruding part. An inclination angle of the first protruding part with respect to the plate-shaped part is a first angle, an inclination angle of the second protruding part with
(Continued)

respect to the plate-shaped part is a second angle, and the second angle is different from the first angle. The second protruding part is placed adjacent to the first protruding part.

4 Claims, 8 Drawing Sheets

(51) Int. Cl.
*F25D 21/12* (2006.01)
*F28D 1/053* (2006.01)

(52) U.S. Cl.
CPC ..... *F28D 1/05366* (2013.01); *F28F 2215/04* (2013.01)

(58) Field of Classification Search
USPC ..... 165/151, 152
See application file for complete search history.

(56) References Cited

U.S. PATENT DOCUMENTS 4,756,362 A * 7/1988 Kudoh ..... F28D 1/0478 165/151
5,722,485 A * 3/1998 Love ..... F28F 1/325 165/151
5,752,567 A * 5/1998 Obosu ..... F28F 1/325 165/151
6,401,809 B1 * 6/2002 Zhang ..... F28F 1/128 165/111
6,543,527 B1 * 4/2003 Bouzida ..... F28F 1/128 165/152
6,883,598 B2 * 4/2005 Sandberg ..... F28F 1/128 165/151
8,210,505 B2 * 7/2012 Thonnelier ..... B01J 19/30 261/112.2
2003/0136554 A1 * 7/2003 Hu ..... F28F 1/128 165/151
2004/0173344 A1 * 9/2004 Averous ..... B01J 19/249 165/173
2004/0206484 A1 * 10/2004 Shimoya ..... F28D 1/05383 165/152
2007/0240865 A1 * 10/2007 Zhang ..... F28F 1/128 165/152
2008/0190589 A1 * 8/2008 Kramer ..... F28F 1/128 165/152
2009/0173479 A1 7/2009 Huang
2010/0243226 A1 * 9/2010 Huazhao ..... F28F 1/128 165/182
2011/0139428 A1 6/2011 Kim et al.
2011/0315362 A1 * 12/2011 Jiang ..... F28D 1/05375 165/173

FOREIGN PATENT DOCUMENTS

JP 63-163788 A 7/1988
JP 60-12088 U 4/2002
JP 2003-156295 A 5/2003
JP 2010-2138 A 1/2010
KR 20030090467 A * 11/2003 ..... F28F 3/02

OTHER PUBLICATIONS

International Preliminary Report of corresponding PCT Application No. PCT/JP2012/061046.
International Search Report of corresponding PCT Application No. PCT/JP2012/061046.
European Search Report of corresponding EP Application No. 12 78 5972.6 dated Oct. 1, 2014.

* cited by examiner

HEAT EXCHANGER

CROSS-REFERENCE TO RELATED APPLICATIONS

This U.S. National stage application claims priority under 35 U.S.C. §119(a) to Japanese Patent Application No. 2011-108594, filed in Japan on May 13, 2011, the entire contents of which are hereby incorporated herein by reference.

TECHNICAL FIELD

The present invention relates to a heat exchanger, and particularly relates to an air-cooled and ventilated heat exchanger.

BACKGROUND ART

Heat exchangers are used for heating and cooling air in outdoor units for air-conditioning devices, heat-source units for hot-water-supplying devices, and the like. Types of heat exchangers include layered heat exchangers such as given in, e.g., Japanese Laid-Open Patent Application No. 2010-2138, in addition to types in which heat-transfer tube having a circular cross-section are inserted into fins. Layered heat exchangers have a configuration in which flat heat-transfer tubes are positioned at a plurality of stages in a state in which a flat part, which expands in the shape of a horizontal surface, faces a vertical direction, where fins are positioned in ventilation spaces sandwiched by adjoining flat heat-transfer tubes.

There also exist heat exchangers such as given in Japanese Laid-Open Patent Application No. 2005-3350. A plurality of louvers are provided to the fins of the heat exchanger according to Japanese Laid-Open Patent Application No. 2005-3350 at predetermined intervals along a direction of air flow. In particular, multiple types of louvers having different louver widths are positioned in a mixed fashion in Japanese Laid-Open Patent Application No. 2005-3350.

SUMMARY

Technical Problem

Since outdoor units and heat-source units are disposed outdoors, frost will adhere to the heat exchanger within these units during periods of low outside air temperature e.g. during winter. Air-conditioning devices and hot-water-supplying devices can therefore perform defrosting operations to remove the frost.

However, while frost melts to form water droplets due to the defrosting operations in the heat exchanger of Japanese Laid-Open Patent Application No. 2005-3350, the water droplets accumulate between adjoining louvers due to surface tension and other factors. When heating or other operations are performed in a state in which water droplets have accumulated, air does not readily pass through the portions of the heat exchanger in which water droplets have accumulated between louvers, and the heat-exchange efficiency of the heat exchanger therefore deteriorates. The water droplets that have accumulated between the louvers may also freeze once again as a result of low outside air temperatures, inviting further deterioration of heat-exchange efficiency.

It is accordingly an object of the present invention to improve water drainage in the space between louvers.

Solution to Problem

A heat exchanger according to a first aspect of the present invention is an air-cooled and ventilated heat exchanger, comprising a fin and a plurality of heat-transfer tubes. The fin has a plate-shaped part and protruding parts. The plate-shaped part is positioned so that a plate-thickness direction intersects an air-flow direction generated by ventilation. The plurality of the protruding parts protrude from the plate-shaped part in the plate-thickness direction. The plurality of the heat-transfer tubes are inserted into the fin so as to intersect the air-flow direction. The plurality of the protruding parts have a first protruding part and a second protruding part. An inclination angle of the first protruding part with respect to the plate-shaped part is a first angle. An inclination angle of the second protruding part with respect to the plate-shaped part is a second angle, the second angle being different from the first angle. The second protruding part is placed in alternation with the first protruding part.

The fins of the heat exchanger have a structure in which the first protruding parts and the second protruding parts, which have different inclination angles with respect to the plate-shaped part, are arranged in alternation. Even when frost has melted to form water droplets due to defrosting operations, the counterbalance between forces (e.g., surface tension and friction force) on the water droplets between the first protruding parts and the second protruding parts is consequently not maintained. Water droplets are therefore prevented from accumulating between the protruding parts, and water drainage between the protruding parts is improved. The efficiency of the heat exchanger can therefore be prevented from deteriorating.

A heat exchanger according to a second aspect of the present invention is the heat exchanger according to the first aspect of the present invention, wherein the protruding parts are formed by cutting and raising a part of the plate-shaped part.

The protruding parts in the heat exchanger are formed integrally with the plate-shaped part. Therefore, the protruding parts need not be formed on the plate-shaped part using separate members, and the fins that include the protruding parts can be easily formed using dies or the like.

A heat exchanger according to a third aspect of the present invention is the heat exchanger according to the first or second aspect of the present invention, wherein the heat exchanger is used in a refrigerating device capable of performing a defrosting operation for removing frost formed on the heat exchanger.

The performing of the defrosting operations by the refrigerating device in which the heat exchanger is used causes the frost between the protruding parts of the heat exchanger to melt to form water droplets. The water droplets do not remain between the protruding parts due to the structure of the fins according to the aforedescribed first aspect. The heat-transfer efficiency of the heat exchanger can therefore be prevented from decreasing.

Advantageous Effects of Invention

The heat exchanger according to the first aspect of the present invention allows water droplets to be prevented from accumulating between the protruding parts, and allows water drainage between the protruding parts to be improved. The efficiency of the heat exchanger can therefore be prevented from deteriorating.

The heat exchanger according to the second aspect of the present invention removes the need for the protruding parts therefore to be formed on the plate-shaped part using separate members, and allows the fins that include the protruding parts to be easily formed using dies or the like.

According to the heat exchanger according to the third aspect of the present invention, the defrosting operations cause the frost between the protruding parts of the heat exchanger to melt to form water droplets. The water droplets do not remain between the protruding parts due to the structure of the fins according to the aforedescribed first aspect. The heat-transfer efficiency of the heat exchanger can therefore be prevented from decreasing.

DESCRIPTION OF EMBODIMENTS

The details of the heat exchanger according to the present invention will be described below with reference to the drawings. The embodiments below are specific examples of the present invention and do not limit the technical scope of the present invention.

First Embodiment (1) Overview

Figure 1:
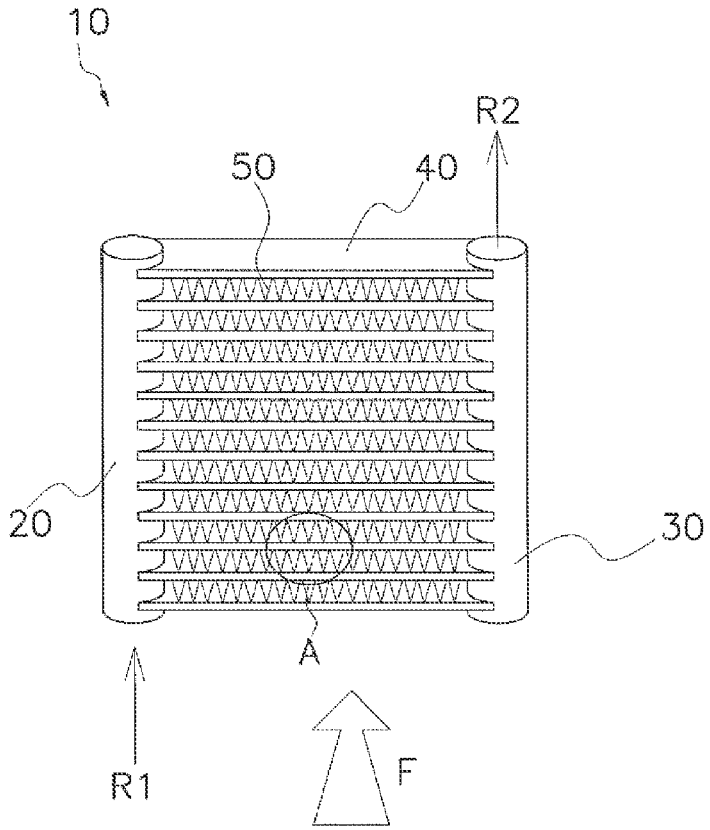
FIG. 1 is an external view of a heat exchanger according to a first embodiment.

FIG. 1 is an external view of a heat exchanger 10 according to an embodiment of the present invention. The heat exchanger 10 is provided to the interior of an outdoor unit of an air-conditioning device and can function as an evaporator for refrigerant or a radiator for refrigerant.

Though not shown in the drawings, the aforedescribed air-conditioning device in the present embodiment is exemplified by the separated type, which is configured so as to be divided into an outdoor unit that is disposed outdoors and an indoor unit that is disposed indoors. Besides cooling and heating, examples of the types of operations of the air-conditioning device include defrosting for removing frost adhering to the heat exchanger 110 in an outdoor device.

The heat exchanger 10 according to the present embodiment is air-cooled and ventilated. The air-conditioning device is therefore provided with a ventilator (not shown) for supplying air flow to the heat exchanger 10. An air-flow direction is indicated by "F" below and in the drawings.

The ventilator may be positioned downstream or upstream of the heat exchanger 110 with respect to the air-flow direction F generated by the ventilator. A member or the like other than the ventilator forms the ventilation channel can be used to automatically change the air-flow direction F of the air flow formed by the ventilator. The heat exchanger is positioned so that when air passes through the heat exchanger 10 after the automatic change in orientation of the air, the air passes in a substantially horizontal direction.

In a state where air is supplied from the ventilator to the heat exchanger 10 functioning as a refrigerant evaporator, the heat exchanger 10 uses the air supplied by the ventilator and performs heat exchange. During heat exchange between the refrigerant and the air in such cases, the refrigerant that flows through the interior of a flat heat-transfer tube (described hereinafter) is warmed and evaporated by the heat of the air supplied by the ventilator. On the other hand, the air passing through the heat exchanger 10 is cooled by the heat of the refrigerant flowing through the interior of the flat heat-transfer tube, and the temperature decreases. The surface temperature of the heat exchanger 10 is lower than the temperature of the supplied air at such times, and therefore dew condensation water is generated on the surface of the heat exchanger 10 when the supplied air is cooled. The dew condensation water turns to frost under low outside air temperatures and adheres primarily to the surface of the heat exchanger 10.

The heat exchanger 10 according to the present embodiment has a structure for draining water droplets in cases where frost has adhered to the surface of the heat exchanger 10 and been melted by a defrosting operation.

(2) Configuration of the Heat Exchanger

Details of the structure of the heat exchanger 110 according to the present embodiment will be described next. The heat exchanger 10 is principally provided with a flow-splitting header 20, a flow-merging header 30, a group 40 of flat heat-transfer tubes, and fins 50, as shown in FIG. 1.

In the descriptions below, "up," "down," "right," "vertical," "horizontal," and other expressions indicating direction are used as appropriate, but these expressions represent directions in a state in which the heat exchanger 10 is positioned in the state of FIG. 1. The side from which the heat exchanger 10 can be seen is the "front-surface side," as shown in FIG. 1, and the "upper-surface side" and the "lower-surface side" can be ascertained using the front-surface side as a reference.

(2-1) Flow-Splitting Header and the Flow-Merging Header

Longitudinal directions of the flow-splitting header 20 and the flow-merging header 30 are both oriented vertically, as shown in FIG. 1. The group 40 of flat heat-transfer tubes is linked to the flow-splitting header 20 and the flow-merging header 30. Specifically, the flow-splitting header 20 and the flow-merging header 30 both extend in parallel separated by a predetermined distance. The various flat heat-transfer tubes 41, 42, 43 . . . in the group 40 of flat heat-transfer tubes are arranged along the longitudinal direction of the flow-splitting header 20 and the flow-merging header 30, and are linked to the flow-splitting header 20 and the flow-merging header 30.

Refrigerant in a liquid state or refrigerant in a gas-liquid two-phase state is fed to the flow-splitting header 20 from a direction R1 in FIG. 1. The refrigerant supplied to the flow-splitting header 20 is divided into a plurality of flow channels present in the flat heat-transfer tubes 41, 42, 43 . . . and flows to the flow-merging header 30.

The flow-merging header 30 is provided to the same position as the flow-splitting header 20 in a component of the air-flow direction F. The flow-merging header merges the refrigerant flowing from the plurality of flow channels present in the plurality of the flat heat-transfer tubes 41, 42, 43 . . . and feeds the refrigerant out in a direction R2 in FIG. 1.

(2-2) The Group of Flat Heat-Transfer Tubes

The group 40 of flat heat-transfer tubes is configured by the plurality of the flat heat-transfer tubes 41, 42, 43 . . . (corresponding to heat-transfer tubes).

Figure 3:
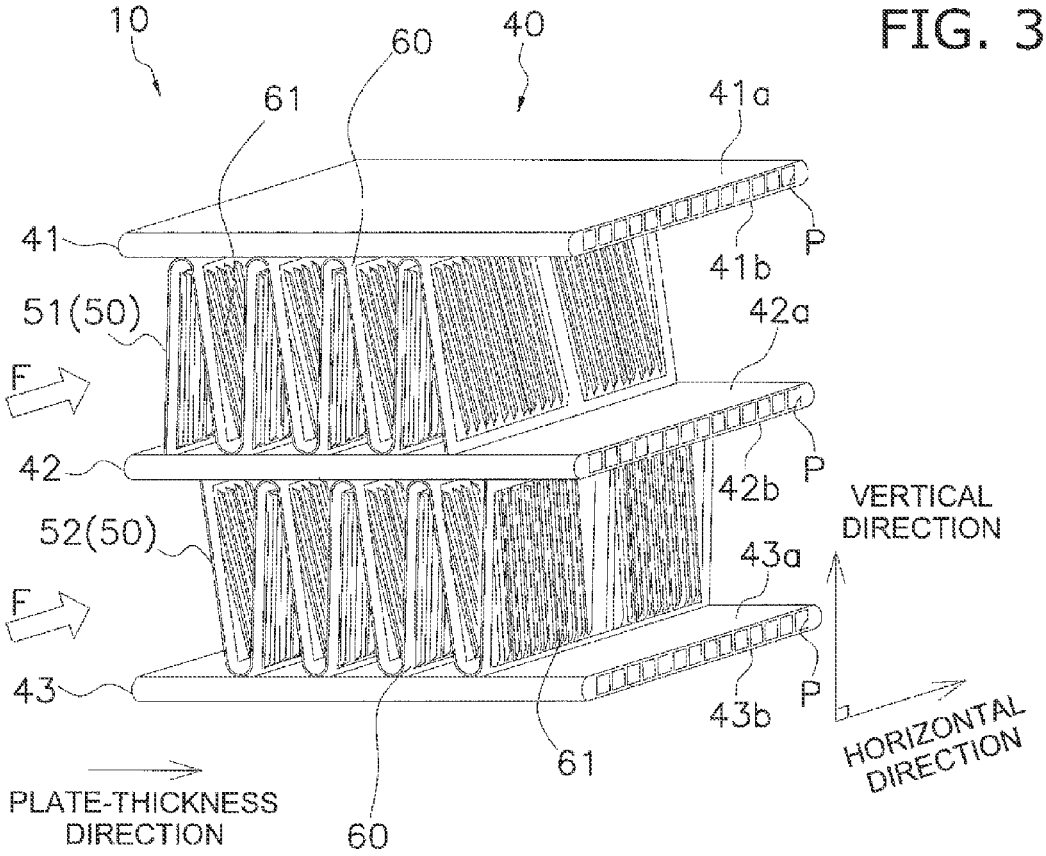
FIG. 3 is a schematic perspective view of the heat exchanger according to the first embodiment.
Figure 4:
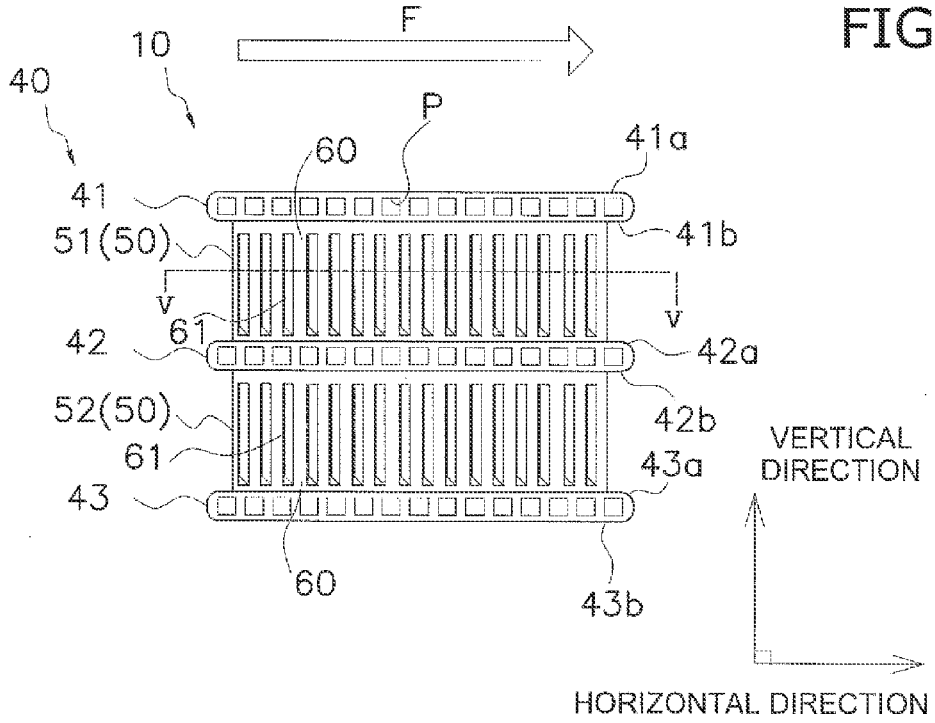
FIG. 4 is a lateral view from the right side of the heat exchanger of FIG. 3 and is a horizontal section cut at the plane indicated by IV-IV in FIG. 2.

The flat heat-transfer tubes 41, 42, 43 . . . are formed from aluminum or an aluminum alloy and are inserted into fins 50 so as to intersect (substantially perpendicularly) the air-flow direction F generated by the ventilation. More specifically, the flat heat-transfer tubes 41, 42, 43 . . . are all positioned aligned and separated at predetermined intervals in the vertical direction, as shown in FIGS. 3 and 4, and have flat surfaces 41*a*, 41*b*, 42*a*, 42*b*, 43*a*, 43*b* . . . that expand in the shape of horizontal surfaces substantially parallel to the air-flow direction F generated in the horizontal direction by the ventilation. The flat surfaces 41*a*, 41*b*, 42*a*, 42*b*, 43*a*, 43*b* . . . expand in the horizontal direction on the upper vertical side and the lower vertical side. The flat surfaces 41*a*, 41*b*, 42*a*, 42*b*, 43*a*, 43*b* . . . thus expand horizontally, and therefore the flat heat-transfer tubes 41, 42, 43 . . . can minimize resistance to ventilation in relation to the air-flow F flowing along the horizontal direction in comparison to case in which the tubes are positioned inclined from the horizontal direction.

The flat heat-transfer tubes 41, 42, 43 . . . have a plurality of refrigerant channels P for causing refrigerant to flow in a direction substantially perpendicular to the air-flow direction F, as shown in FIG. 4, and are "porous." The plurality of the refrigerant channels P are provided to the interior of the flat heat-transfer tubes 41, 42, 43 . . . aligned along the air-flow direction F in order to form the flat heat-transfer tubes 41, 42, 43 . . . into a flat shape. The tube diameter of the refrigerant channels P is extremely small. Each of the tubes has a square shape of approximately 250 μm×approximately 2.50 μm and is a "microchannel heat exchanger."

(2-3) Fins

Figure 2:
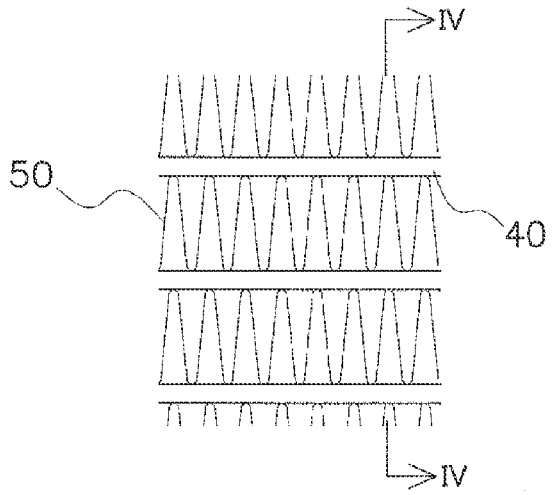
FIG. 2 is a magnified view of the portion indicated by "A" in FIG. 1.

The fins 50 are positioned joined to at least one of the adjoining flat heat-transfer tubes 41, 42, 43 . . . in between at least the adjoining flat heat-transfer tubes 41, 42, 43 . . . , as shown in FIGS. 2 through 4.

More specifically, the fins 50 have a first fin 51, a second fin 52, and the like that are provided in a disconnected fashion between the adjoining flat heat-transfer tubes 41, 42, 43 . . . , such as between the adjoining flat heat-transfer tubes 41, 42 and between the flat heat-transfer tubes 42, 43. The first fin 51 and the second fin 52 are both formed having repeated mountain and valley portions when viewed from the front of the heat exchanger 10 in FIG. 1 and have a "wave" shape. The first fin and the second fin are formed from aluminum or an aluminum alloy.

The first fin 51 is positioned so as to be sandwiched by the flat heat-transfer tubes 41, 42. The upper-surface sides of the mountain portions contact the flat surface, 41*b*, which is the bottom-surface side of the flat heat-transfer tube 41, and the lower-surface sides of the valley portions contact the flat surface 42*a*, which is the upper-surface side of the flat heat-transfer tube 42. The second fin 52 is positioned so as to be sandwiched by the flat heat-transfer tubes 42, 43. The upper-surface sides of the mountain portions contact the flat surface 42*b*, which is the bottom-surface side of the flat heat-transfer tube 42, and the lower-surface sides of the valley portions contact the flat surface 43*a*, which is the upper-surface side of the flat heat-transfer tube 43. The portions of the group 40 of flat heat-transfer tubes and the fins 50 that make contact as described above are immobilized by brazing. The heat of the refrigerant flowing within the group 40 of flat heat-transfer tubes is thereby transferred not only to the surface of the group 40 of flat heat-transfer tubes but also to the surface of the fins 50. Therefore, the heat-transfer surface area of the heat exchanger 10 is increased, the efficiency of heat exchange is improved, and the heat exchanger 10 can be made more compact. The heat exchanger 10 according to the present embodiment has the group 40 of flat heat-transfer tubes and the fins 50 overlaid in alternation in the vertical direction and is a so-called layered heat exchanger. The interval between the flat heat-transfer tubes 41, 42, 43 . . . can therefore be readily ensured by the interposed fins 50, and the assembly workability of the heat exchanger 10 can be improved.

(2-4) Plate-Shaped Part and Louvers

The fins 50 having the aforedescribed configuration have a plate-shaped part 60 and a plurality of louvers 61 (corresponding to protruding parts). The plate-shaped part 60 is positioned so that a plate-thickness direction intersects the air-flow direction F, and is a portion on the fin 50 that expands flat from the mountain portion to the valley portion of the shape of the fin 50, as shown in FIGS. 3, 4. The plane of the plate-shaped part 60 substantially follows along the air-flow direction F. Such a configuration for the plate-shaped part 60 allows the resistance to ventilation that results from providing the fins 50 to be minimized. The thickness of the fins 50 in the present embodiment is approximately 0.1 mm, and a distance Y1 (see FIG. 5) between the plate-shaped parts 60 is approximately 1.5 mm.

Figure 5:
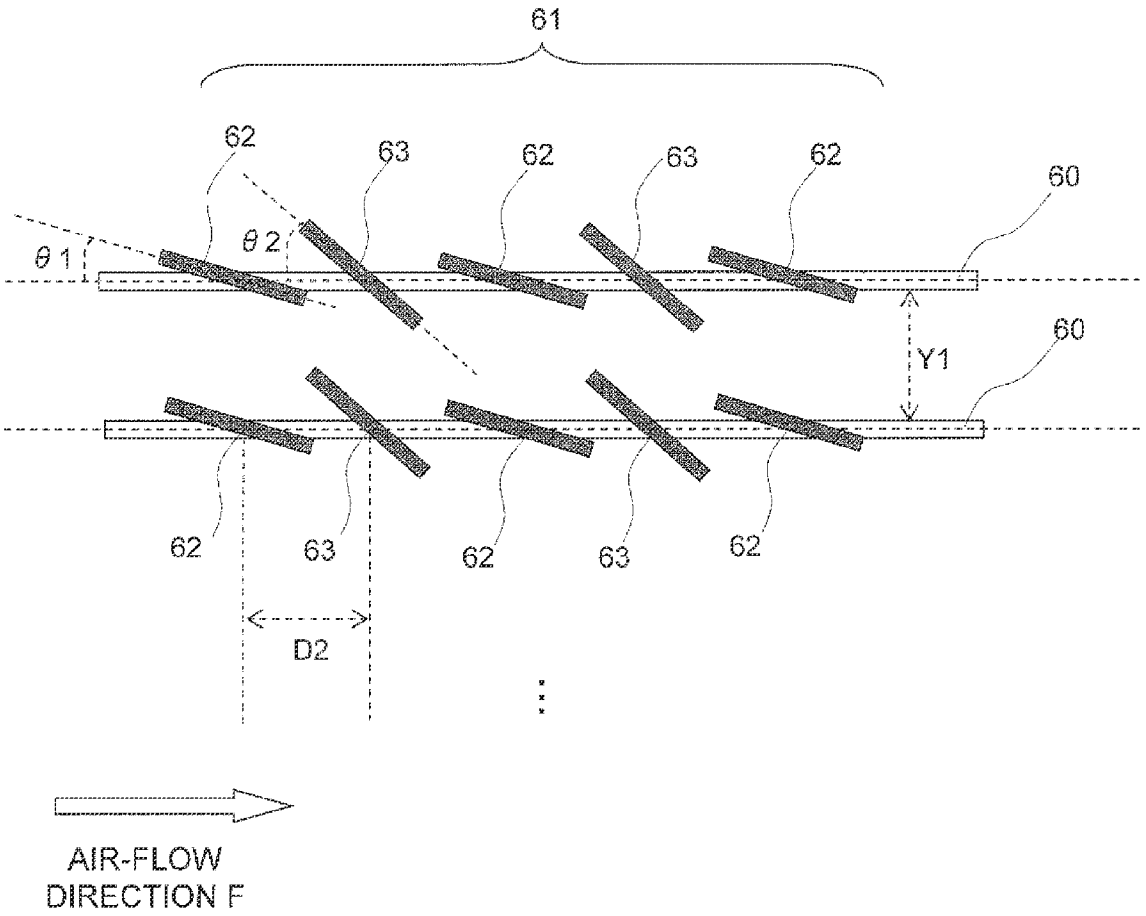
FIG. 5 is horizontal cross-sectional view of the fins when cut at the plane indicated by V-V in FIG. 4.

The plurality of the louvers 61 protrude from the plate-shaped part 60 in the plate-thickness direction, as shown in FIG. 5. The louvers 61 have a long, thin, rectangular shape along a direction in which the adjoining flat heat-transfer tubes 41, 42, 43 are arranged, i.e., in the vertical direction, as shown in FIG. 4.

Figure 6:
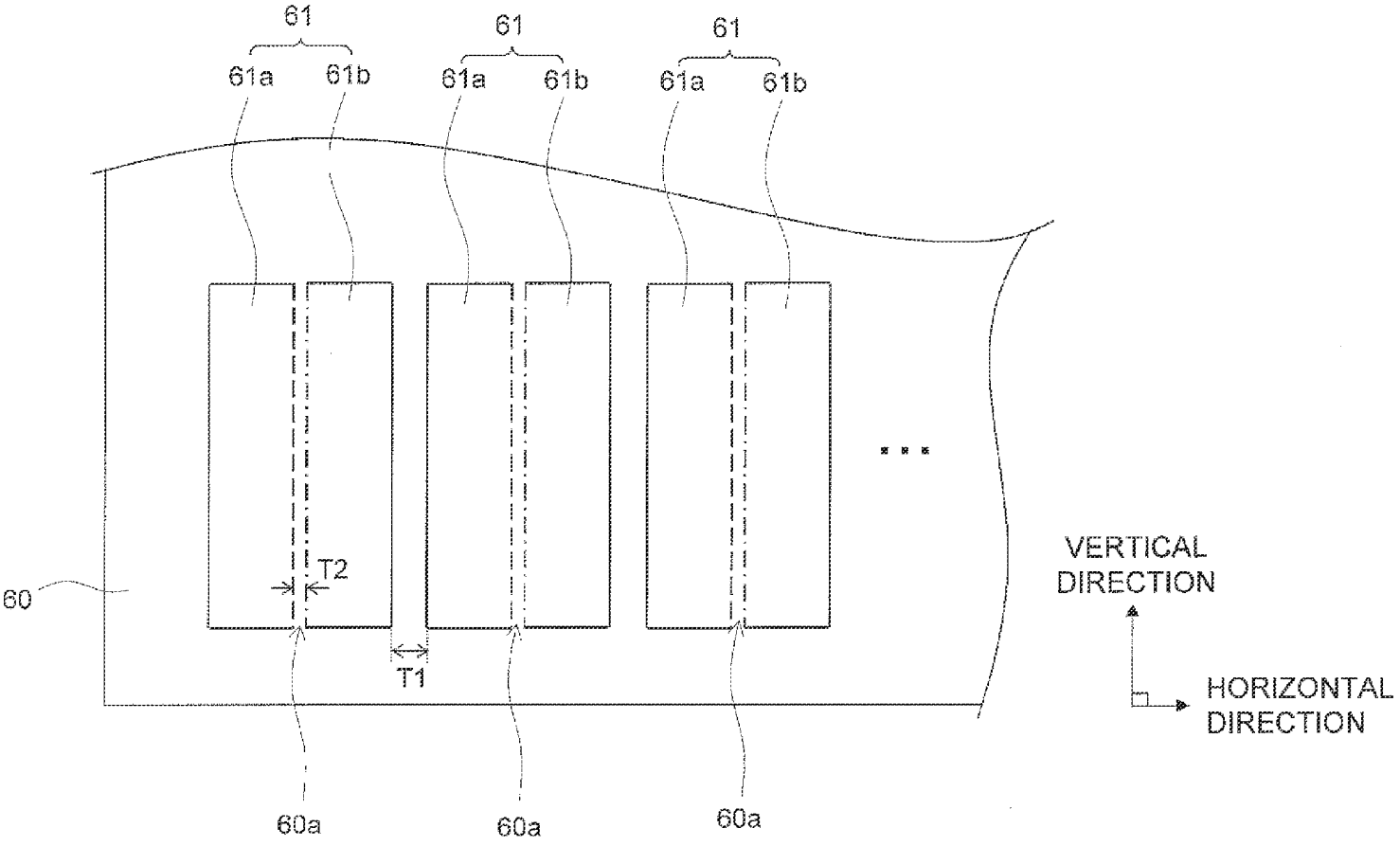
FIG. 6 is a drawing for depicting a process for forming the louvers by cutting and raising.

The louvers 61 are formed by cutting and raising parts of the plate-shaped part 60. Specifically, cuts are made in plate-shaped aluminum or aluminum alloy along the solid lines in FIG. 6, dotted lines in FIG. 6 are mountain-folded, and dash-dotted lines are valley-folded, whereby the louvers 61 are formed integrally with the plate-shaped part 60. Folding is performed so that an angle at which a portion 61*a* of the louver 611 is inclined relative to the plate-shaped part 60 and an angle at which a portion 61*b* of the louver 61 is inclined relative to the plate-shaped part 60 are equal. The portions 61*a*, 61*b* of the louver 61 that adjoin via a portion 60*a* of the plate-shaped part 60 therefore protrude in opposite directions with respect to the plate-shaped part 60 but have the same inclination angle with respect to the plate-shaped part 60. In other words, the plate-shaped part 60 can be said to be the substantially smooth portion of the plate-shaped aluminum or aluminum alloy that does not protrude in the plate-thickness direction. The louvers 61 can be said to be parts that are cut and raised to align facing the air-flow direction F on both surfaces of the plate-shaped part 60. For ease of description in the present embodiment, one pair of the portions 61*a*, 61*b* will be described as corresponding to one of the louvers 61.

A predetermined interval T1 is provided in the horizontal direction for each pair of the portions 61*a*, 61*b*. This interval is larger than a width T2 of the portion 60*a* of the plate-shaped part 60 in the horizontal direction. The width of the portion 61*a* of the louver 61 in the horizontal direction in FIG. 6 is equal to the width of the portion 61*b* in the horizontal direction of FIG. 6.

In particular, the plurality of the louvers 61 according to the present embodiment do not all have the same inclination angle with respect to the plate-shaped part 60. First louvers 62 (corresponding to the first protruding part) and second louvers 63 (corresponding to the second protruding part) that have different inclination angles are present. In other words, the first louvers 62 incline at a first angle θ1 with respect to the plate-shaped part 60, and the second louvers 63 incline at a second angle θ2, which is different from the first angle θ1, with respect to the plate-shaped part 60, as shown in FIG. 5. The second angle θ2 of the second louvers 63 is larger than the first angle θ1 of the first louvers 62. The first louvers 62 and the second louvers 63 are positioned in alternation.

The actual values of the first angle θ1 and the second angle θ2 are set appropriately using manual calculations, simulations, experiments, or the like in consideration of facilitating the flow of air in the fins 50 and the downward flow of water droplets between the louvers 62, 63. The range for the first angle θ1 is, e.g., approximately 10° to approximately 25°, and the range for the second angle θ2 is, e.g., approximately 30° to approximately 45°. Example combinations of the first angle θ1 and the second angle θ2 include approximately 20° for the first angle θ1 and approximately 40° for the second angle θ2, or approximately 25° for the first angle θ1 and approximately 35° for the second angle θ2. In particular, in cases where the second angle θ2 is approximately 30°, the length of the second louver 63 in a protruding direction reaches a height of approximately 0.4 mm from a distal-end part of the second louver 63 in the protruding direction to the plate-shaped part 60.

The first louvers 62 and the second louvers 63 in the present embodiment are inclined toward the upstream side in the air-flow direction F, as shown in FIG. 5.

Figure 7A:
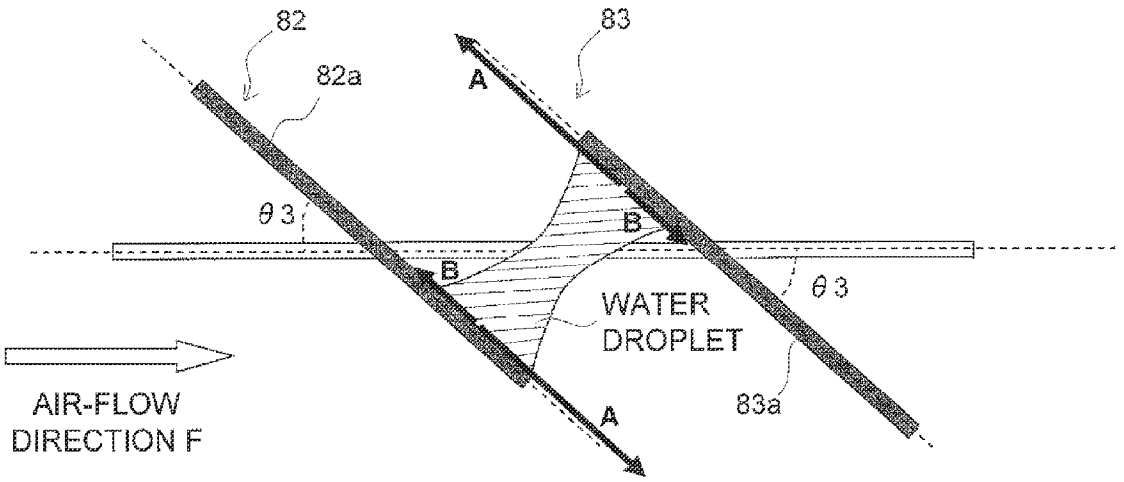
(PRIOR ART) FIG. 7A
FIG. 7A is a drawing for depicting forces acting on water droplets that have accumulated between adjoining louvers in cases where the inclination angles of adjoining louvers are parallel, as in conventional heat exchangers.
Figure 7B:
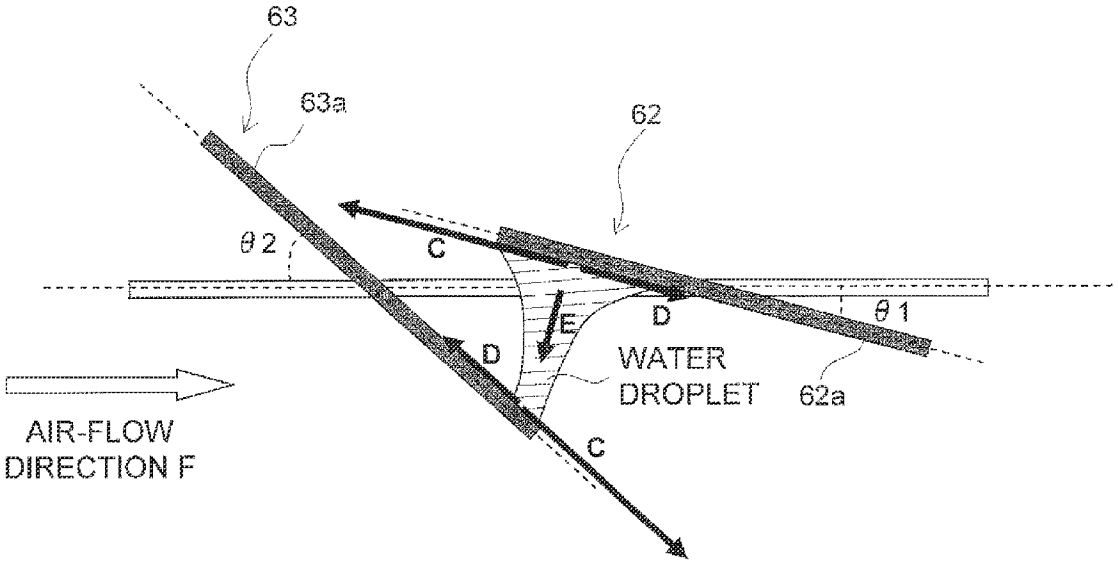
FIG. 7B is a drawing for depicting the forces acting on water droplets that have accumulated between the first louver and the second louver in the heat exchanger of the present embodiment.

The differences between the case of the present embodiment, in which the first louvers 62 and the second louvers 63 are arranged in alternation, and a conventional case, in which all the louvers have the same inclination angle relative to the plate-shaped part 60, will be described in detail with reference to FIG. 7. FIG. 7(*a*) displays forces acting on water droplets, which have accumulated between adjoining louvers, as arrows A, B in a conventional case where all of the louvers have an identical inclination angle θ3 with respect to the plate-shaped part 60. FIG. 7(*b*) displays the forces acting on water droplets, which have accumulated between the adjoining first and second louvers 62, 63, as arrows C, D, E in a case where the plurality of the louvers 61 have the first louver 62 and the second louver 63 according to the present embodiment. The width of the louvers in FIG. 7(*a*) and the width of the louvers in FIG. 7(*b*) are the same. The inclination angle θ3 in FIG. 7(*a*) is, e.g., approximately 20° to 30°.

The air-conditioning device performs defrosting operations, whereby frost adhering to the heat exchanger is melted and forms water droplets. In a case where the inclination angles θ3 of adjoining louvers 82, 83 are equal, the louvers 82, 83 are parallel to each other, the water droplet resulting from the defrosting operation contacts mutually facing surfaces 82*a*, 83*a* of the louvers 82, 83, and the water droplet is held between the louvers 82, 83, as shown in FIG. 7(*a*). In the water droplet in such cases, a surface-tension force resulting from capillary action acts in the direction of the arrow A on the surfaces 82*a*, 83*a* of the louvers 82, 83. A friction force that serves as a drag on the surface tension (arrow A) further acts in the direction of the arrow B in the water droplet on the surfaces 82*a*, 83*a* of the louvers 82, 83. The surface tension and the friction act on the surfaces 82*a*, 83*a*, which are identical in all respects other than their orientation. The magnitudes of the surface tension on the surface 82*a* and the surface tension on the surface 83*a* are equivalent, as are the magnitudes of the friction force on the surface 82*a* and the friction force on the surface 83*a*. The forces acting on the water droplet in FIG. 7(*a*) therefore counterbalance each other, so that the water droplet does not flow downward but gets held between the louvers 82, 83.

In contrast, in a case where the first louver 62 and the second louver 63, which have different inclination angles, are positioned in alternation, the water droplet resulting from the defrosting operation contacts the mutually facing surfaces 62*a*, 63*a* of the louvers 62, 63, and is momentarily held between the louvers 62, 63, as shown in FIG. 7(*b*). In the water droplet, a surface-tension force resulting from capillary action acts in the direction of the arrow C on the surfaces 62*a*, 63*a* of the louvers 62, 63. A friction force that serves as a drag on the surface tension (arrow C) further acts in the direction of the arrow D in the water droplet on the surfaces 62*a*, 63*a* of the louvers 62, 63. However, since the inclination angles θ1, θ2 of the adjoining louvers 62, 63 are both different, not only are the directions of the surface tensions and friction forces acting on the water droplet different, but even if, e.g., the magnitudes of the surface tensions acting on the surface 62*a* and the surface 63*a* and of the friction forces acting on the surface 62*a* and the surface 63*a* are equivalent, the fact that the louvers 62, 63 are not parallel means that the forces acting on the water droplet do not counterbalance each other. A potential for causing the water droplet to flow downward is thus produced. The water droplet extends vertically due to this potential, but a downward force is produced on the water droplet as a result of the weight thereof, and the water droplet flows downward without being held between the louvers 62, 63.

In other words, the first louver 62 and the second louver 63 according to the present embodiment allow the contact surface area of the water droplet between the adjoining first and second louvers 62, 63 to be less than with the conventional louvers according to FIG. 7(*a*). Water drainage is therefore improved over the conventional technology.

In particular, the first louvers 62 and the second louvers 63 in the present embodiment are positioned in alternation on the same plate-shaped part 60. The adjoining louvers 61 are therefore never parallel, and the aforedescribed effects are generated between the adjoining louvers 61.

(3) Refrigerant Flow

Refrigerant flows in the heat exchanger 10 having the above structure. An aspect in which refrigerant flows from the heat exchanger 10 will be simply described. A case will be described in which the air-conditioning device performs heating operations; i.e., where the heat exchanger 10 functions as an evaporator.

Liquid refrigerant or refrigerant in a gas-liquid two-phase state first flows into the flow-splitting header 20. The refrigerant flow is split substantially evenly into the refrigerant channels P of the flat heat-transfer tubes 41, 42, 43 . . . of the group 40 of flat heat-transfer tubes.

While the refrigerant flows through the interior of refrigerant channels P of the flat heat-transfer tubes 41, 42, 43 . . . , the fins 50 and the group 40 of flat heat-transfer tubes themselves are warmed by air supplied by the ventilator (not shown), and the refrigerant flowing through the interior of the refrigerant channels P is also warmed. Heat is thus applied to the refrigerant, whereby the refrigerant gradually evaporates and enters a gas phase in the process of passing through the inside of the refrigerant channels P. Water components in the air cooled by the heat of the refrigerant during this process form dew condensation water and adhere to the surface of the heat exchanger 10.

The refrigerant that has entered the gas phase is then merged by the flow-merging header 30 after passing through the refrigerant channels P of the flat heat-transfer tubes 42, 43, and the like, becomes a single refrigerant flow, and flows out from the heat exchanger 10.

(4) Characteristics (4-1)

The fins 50 of the heat exchanger 10 according to the present embodiment have a structure in which the first louvers 62 and the second louvers 63, which have different inclination angles θ1, θ2 with respect to the plate-shaped part 60, are arranged in alternation. Even when frost has melted to form water droplets due to defrosting operations, the counterbalance between surface tension, friction force, and other forces acting on the water droplets between the first louvers 62 and the second louvers 63 is thereby not maintained, and a potential for leading the water droplets in the direction of the arrow E is produced, as shown in FIG. 7(*b*). The water droplets therefore fall downward as a result of their own weight without accumulating between the first louvers 62 and the second louvers 63 and are not held between the first louvers 62 and the second louvers 63. Water drainage between the first louvers 62 and the second louvers 63 is therefore improved, and deterioration of heat-transfer efficiency of the heat exchanger 10 resulting from water droplets being held between the first louvers 62 and the second louvers 63 can be prevented.

(4-2)

In the heat exchanger 10 according to the present embodiment, the plurality of the louvers 61 that include the first louvers 62 and the second louvers 63 are formed by cutting and raising parts of the plate-shaped part 60. In other words, the louvers 61 are formed integrally with the plate-shaped part 60. The louvers 61 therefore need not be formed on the plate-shaped part 60 using separate members, and the fins 50 that include the louvers 61 can be easily formed using dies or the like.

(4-3)

The heat exchanger 10 according to the present embodiment is used in the outdoor unit of an air-conditioning device that can perform defrosting operations for removing frost that has formed on the heat exchanger 10. The performance of the defrosting operations by the air-conditioning device causes the frost between the louvers 61 (i.e., between the first louvers 62 and the second louvers 63) of the heat exchanger 10 to melt to form water droplets. The water droplets do not remain between the adjoining louvers 62, 63 due to the fins 50, which have a structure in which the first louvers 62 and the second louvers 63, which have different inclination angles, are positioned in alternation. The heat-transfer efficiency of the heat exchanger 10 can therefore be prevented from decreasing.

(5) Modifications (5-1) Modification A

The first louvers 62 and the second louvers 63 may be formed on one surface of the plate-shaped part 60 or may be formed on one portion of the plate-shaped part 60. Frost readily forms on the portion of the fins 50 upstream in the air-flow direction F, and therefore, e.g., a structure in which the first louvers 62 and the second louvers 63 are arranged in alternation on the upstream portion may also be employed.

(5-2) Modification B

The interval T1 and the width T2 in FIG. 6 may be the same for all of the first louvers 62 and the second louvers 63 or may be different for each of the louvers 62, 63.

(5-3) Modification C

The number of the first louvers 62 and the second louvers 63 may or may not be the same for each of the plate-shaped parts 60 in the wave-shaped fins 50.

(5-4) Modification D

The fins 50 that are positioned between the flat heat-transfer tubes 41, 42, 43 . . . are described in terms of the first fin 51 and the second fin 52 in the present embodiment. However, the fins need not be positioned between the flat heat-transfer tubes; the first louvers 62 and the second louvers 63 according to the aforedescribed present embodiment can be formed even on the fins 50 on portions contacting any of the flat heat-transfer tubes.

(5-5) Modification E

The heat exchanger 10 in the present embodiment is described as being applied to the outdoor unit of an air-conditioning device. However, the heat exchanger 10 can also be applied as the heat exchanger in the outdoor unit of a refrigeration device other than an air-conditioning device, such as the heat-source unit of a hot-water-supplying device or the like.

The heat exchanger 10 according to the present embodiment can also be used at a minimum as an evaporator for refrigerant instead of functioning as an evaporator or radiator for refrigerant.

(5-6) Modification F

A case is described in the present embodiment in which the heat exchanger 10 is a so-called layered microchannel heat exchanger. However, as tong as a configuration is employed in which the inclination angle of the first louver with respect to the plate-shaped part is different from the second louver, and the first louver and the second louver are positioned in alternation, any type of heat exchanger can be used. Other types of heat exchanger include heat exchanger types in which flat heat-transfer tubes are inserted into insertion tubes provided to plate-shaped fins, heat exchanger types in which heat-transfer tubes having circular cross-sections are inserted into the fins, heat exchangers in which a plurality of fins are positioned on one portion of the flat heat-transfer tubes, and the like.

Second Embodiment

In the present embodiment, a case will be described in which the fins of the heat exchanger have different louvers from the aforedescribed first embodiment. A case will be described in which a heat exchanger 110 according to the present embodiment is provided to the interior of an outdoor unit of an air-conditioning device that can perform defrosting operations as in the aforedescribed first embodiment.

The heat exchanger 110 is an air-cooled and ventilated heat exchanger as in the aforedescribed first embodiment.

(1) Configuration of the Heat Exchanger

Other than the louvers, the configuration of the heat exchanger 110 according to the present embodiment is the same as the structure of the heat exchanger 10 given in the aforedescribed first embodiment. In other words, the heat exchanger 110 is a so-called microchannel heat exchanger provided principally with a flow-splitting header (not shown), a flow-merging header (not shown), a group 140 of flat heat-transfer tubes, and fins 150 (see FIGS. 8, 9).

The flow-splitting header, the flow-merging header, and the group 140 of flat heat-transfer tubes are the same as the flow-splitting header 20, the flow-merging header 30, and the group 40 of flat heat-transfer tubes according to the first embodiment, and therefore the fins 150 will be described below.

(1-1) Fins

Figure 8:
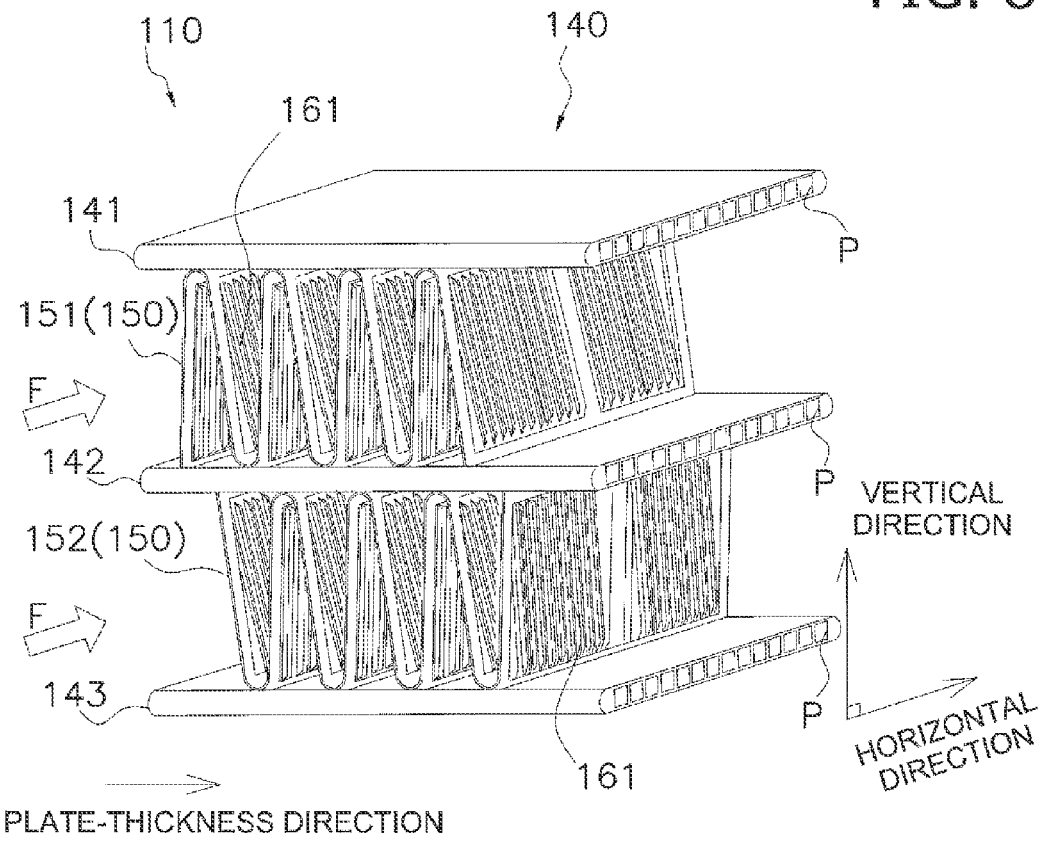
FIG. 8 is a schematic perspective view of a heat exchanger according to a second embodiment.
Figure 9:
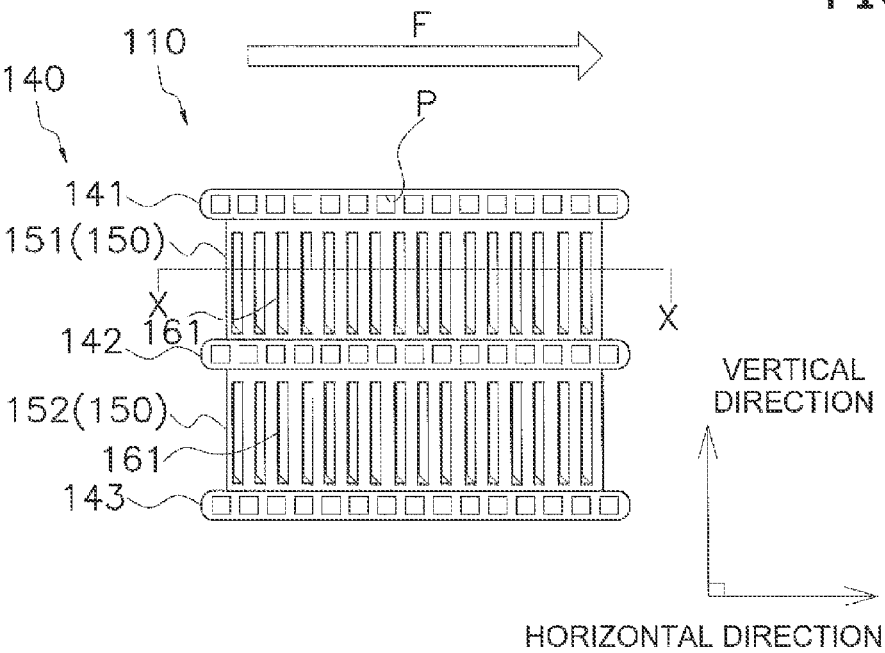
FIG. 9 is a lateral view of the heat exchanger of FIG. 8 as viewed from the right side.

The fins 150 are positioned joined to at least one of adjoining flat heat-transfer tubes 141, 142, 143 . . . in between at least the adjoining flat heat-transfer tubes 141, 142, 143 . . . , as shown in FIGS. 8, 9. The fins 150 have a first fin 151, a second fin 152, and the like that are provided in a disconnected fashion between the adjoining flat heat-transfer tubes 141, 142, 143 . . . . The first fin 151 and the second fin 152 both have a wave shape identical to the first fin 51 and the second fin 52 according to the aforedescribed first embodiment and are formed from aluminum or an aluminum alloy.

The first fin 151 is positioned so as to be sandwiched by the flat heat-transfer tubes 141, 142. The upper-surface sides of the mountain portions of the first fin 151 are each immobilized by brazing welding to a flat surface that is the bottom-surface side of the flat heat-transfer tube 141. The lower-surface sides of the valley portions of the first fin 151 are each immobilized by brazing welding to a flat surface that is the upper-surface side of the flat heat-transfer tube 142. The second fin 152 is positioned so as to be sandwiched by the flat heat-transfer tubes 142, 143. The upper-surface sides of the mountain of the second fin 152 portions are each immobilized by brazing welding to a flat surface that is the bottom-surface of the flat heat-transfer tube 142. The lower-surface sides of the valley portions of the second fin 152 are each immobilized by brazing welding to a flat surface that is the upper-surface of the flat heat-transfer tube 143.

The heat exchanger 110 in the present embodiment is thus a so-called layered microchannel heat exchanger in which the group 140 of flat heat-transfer tubes and the fins 150 are overlaid in alternation in the vertical direction, as in the heat exchanger 10 according to the aforedescribed first embodiment.

(1-2) Plate-Shaped Part and Louvers

The fins 150 have a plate-shaped part 160 and a plurality of louvers 161 (corresponding to protruding parts). The plate-shaped part 160 is positioned so that the plate-thickness direction of the fin 150 intersects the air-flow direction F, and is a portion on the fin 150 that expands flat from the mountain portion to the valley portion of the shape of the fin 150 in the same manner as the plate-shaped part 60, as shown in FIGS. 8, 9. The thickness of the fins 150 in the present embodiment is approximately 0.1 mm, and a distance Y2 (see FIG. 10) between the plate-shaped parts 160 is approximately 1.5 mm.

Figure 10:
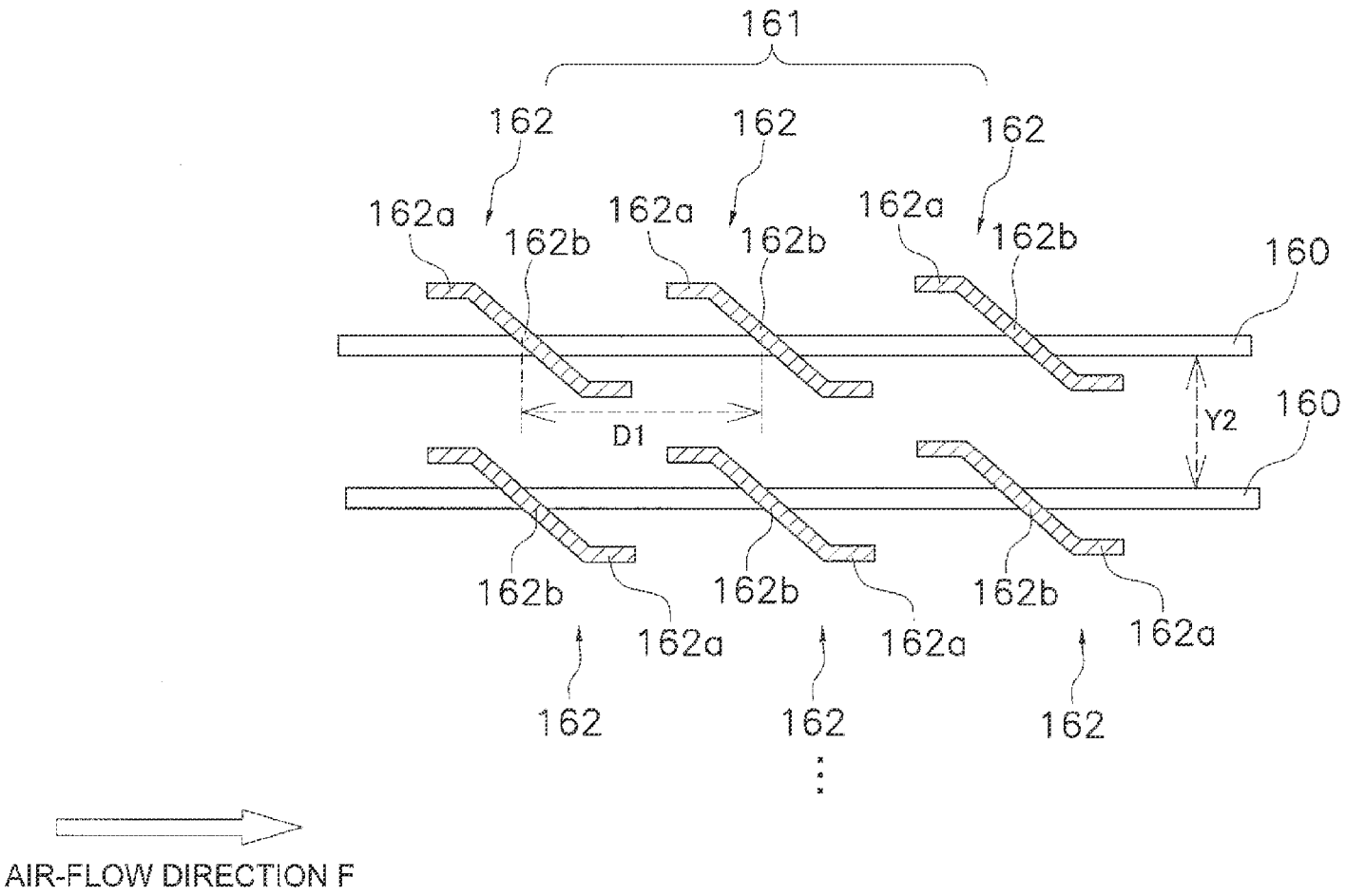
FIG. 10 is a horizontal sectional view of the fins when cut at the surface indicated by X-X in FIG. 9.

The plurality of the louvers 161 protrude from the plate-shaped part 160 in the plate-thickness direction, as shown in FIG. 10. The louvers 161 have a long, thin, rectangular shape along the vertical direction, as shown in FIG. 9. The louvers 161 are formed by cutting and raising parts of the plate-shaped part 160 in the same manner as in the aforedescribed first embodiment.

Figure 11:
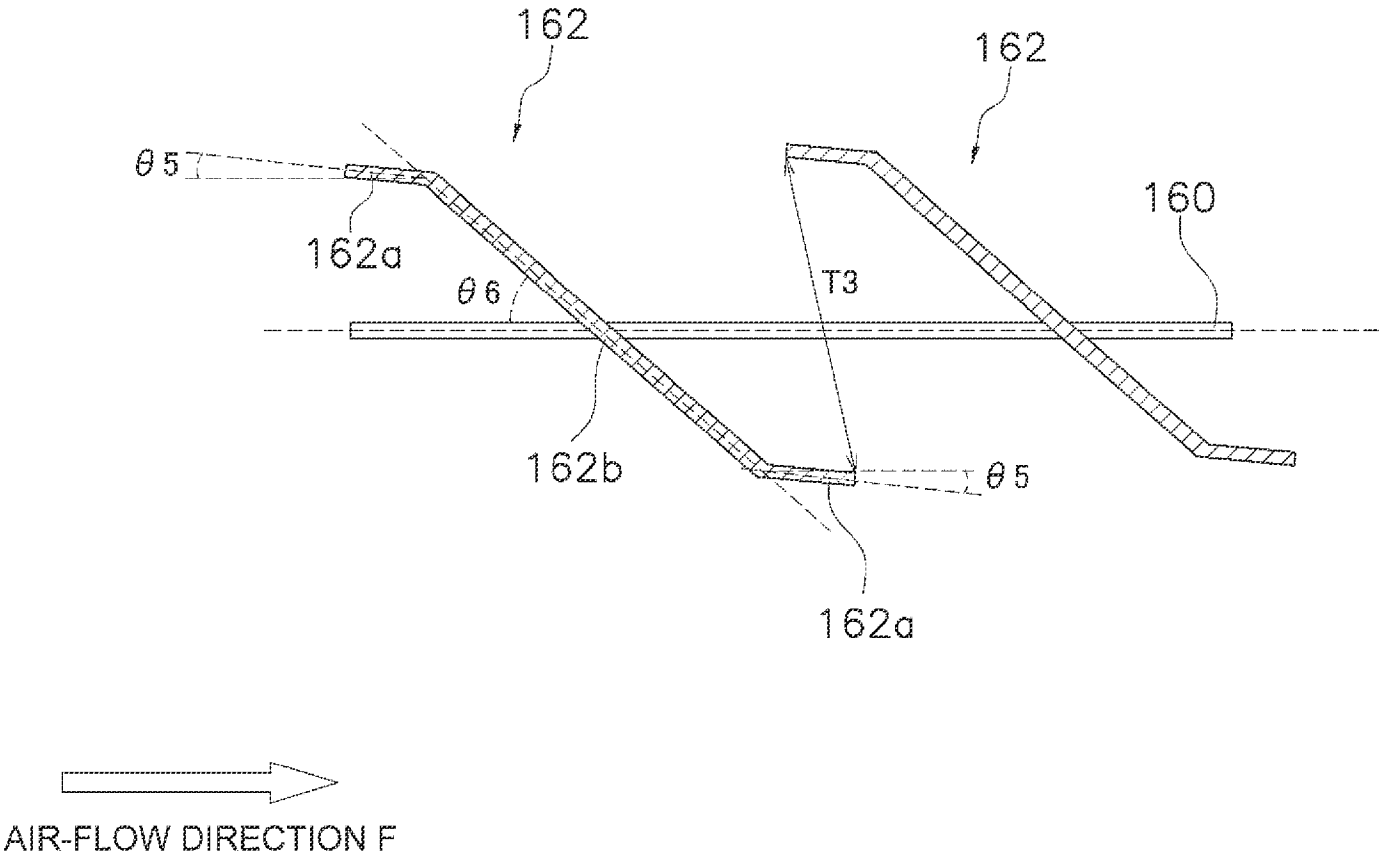
FIG. 11 is a magnified view of the adjoining third louvers and the plate-shaped part in FIG. 10.

In particular, the louvers 161 according to the present embodiment are not configured such that louvers having different inclination angles are positioned in alternation, but have a plurality of third louvers (corresponding to the third protruding part) 162 in which the inclination angles differ between a distal portion 162*a*, which is a portion on the distal side in the protruding direction, and a plate-shape-side portion 162*b*, which is a portion near the plate-shaped part 160, as shown in FIG. 10. In other words, the distal portions 162*a* of the third louvers 162 incline at a fifth angle θ5 with respect to the plate-shaped part 160, and the plate-shape-side portion 162*b* inclines at a sixth angle θ6, which is different from the fifth angle θ5, with respect to the plate-shaped part 160, as shown in FIG. 11. The configuration is such that each of the louvers 162 has two of the distal portions 162*a* and one of the plate-shape-side portions 162*b*. The distal portions 162*a* are folded from the plate-shape-side portion 162*b*, whereby the distal portions 162*a* and the plate-shape-side portion 162*b* are formed integrally. The plate-shape-side portion 162*b* of the third louvers 162 in FIGS. 10 and 11 inclines toward the upstream side in the air-flow direction F, and the distal portions 162*a* incline toward the plate-shaped part 160 more than in a direction in which the plate-shape-side portion 162*b* extends. As an example, the length of the distal portions 162*a* is less than the plate-shape-side portion 162*b* and is, e.g., approximately one third of the plate-shape-side portion 162*b*. The sixth angle θ6 is larger than the fifth angle θ5. A plurality of the third louvers 162 having such a shape are arranged and aligned along the air-flow direction F on the plate-shaped part 160 (see FIG. 9). The third louvers 162 having such a shape are positioned continuously along the air-flow direction F, as shown in FIGS. 10, 11.

The actual values of the fifth angle θ5 and the sixth angle θ6 are set appropriately using manual calculations, simulations, experiments, or the like in consideration of facilitating the flow of air in the fins 150 and the downward flow of water droplets. Specifically, the range for the fifth angle θ5 is, e.g., approximately 10° to approximately 25°, and the range for the sixth angle θ6 is, e.g., approximately 30° to approximately 45°. Example combinations of the fifth angle θ5 and the sixth angle θ6 include approximately 20° for the fifth angle θ5 and approximately 40° for the sixth angle θ6, or approximately 10° for the fifth angle θ5 and approximately 30° for the sixth angle θ6. In cases where the fifth angle θ5 is approximately 10° and the sixth angle θ6 is approximately 30°, a distance T3 of the distal portions 162*a* positioned to symmetrically sandwich the plate-shaped part 160 in the adjoining third louvers 162 is, e.g., 0.9 mm.

A distance D1 (referred to below as contact-point-interval distance D1) between a point at which any of the third louvers 162 contacts the plate-shaped part 160 and a point at which another of the third louvers 162 that adjoins that third louver 162 contacts the plate-shaped part 160 is larger than a contact-point-interval distance D2 (see FIG. 5) between the contact point of the first louver 62 with the plate-shaped part 60 and a contact point of the second louver 63, which adjoins that first louver 62, with the plate-shaped part 60 in the aforedescribed first embodiment. The contact-point-interval distance D1 according to the present embodiment is, e.g., approximately 1.5 to 2.0 times the contact-point-interval distance D2 according to the first embodiment. The interval between the adjoining third louvers 162 is thus expanded, whereby obstruction of airflow resulting from the angle of the distal portions 162*a* in particular is prevented.

Water droplets will temporarily contact the facing surfaces of the adjoining third louvers 162 if the third louvers 162 have the aforedescribed configuration. However, as for the first louver 62 and the second louver 63 shown in FIG. 7(*b*) according to the aforedescribed first embodiment, since the inclination angles of the distal portions 162*a* and the plate-shape-side portions 162*b* differ, the surface tensions and friction forces acting on the water droplets will not counterbalance. A potential for causing the water droplet to flow downward is thus produced, and the water droplet extends vertically, but a downward force is produced on the water droplet as a result of the weight thereof, and the water droplet flows downward without being held between the third louvers 162.

(2) Characteristics (2-1)

The fins 150 of the heat exchanger 110 according to the present embodiment have the third louvers 162. The inclination angle (the fifth angle θ5) of the distal portions 162*a* with respect to the plate-shaped part 160 and the inclination angle (the sixth angle θ6) of the plate-shape-side portion 162*b* with respect to the plate-shaped part 160 are different in the third louvers 162. Even when frost has melted to form water droplets due to defrosting operations, the counterbalance between surface tension, friction force, and other forces acting on the water droplets between the adjoining third louvers 162 is thereby not maintained. Water droplets can therefore be prevented from accumulating between the third louvers 162, and water drainage between the third louvers 162 can be improved. Deterioration of heat-transfer efficiency of the heat exchanger 110 can therefore be prevented.

(2-2)

A plurality of the third louvers 162 are arranged on the plate-shaped part 160 in the present embodiment. The contact-point-interval distance D1 between the adjoining third louvers 162 with the respective plate-shaped parts 160 is larger than the contact-point-interval distance D2 between the first louvers 62 and the second louvers 63 according to the aforedescribed first embodiment. The inclination angle (fifth angle θ5) of the distal portions 162*a* and the inclination angle (sixth angle θ6) of the plate-shape-side portions 162*b* are different in the third louvers 162, thereby air-flow obstructions can be limited, and air can pass through the third louvers 162.

(2-3)

The distal portions 162*a* are formed by being folded from the plate-shape-side portion 162*b* of the third louvers 162 in the present embodiment. The distal portions 162*a* and the plate-shape-side portion 162*b* of the third louvers 162 are thereby formed integrally. The distal portions 162*a* therefore need not be formed using separate members from the plate-shape-side portion 162*b*, and the fins 150 that include the third louvers 162 can be easily formed using dies or the like.

(2-4)

The third louvers 162 of the heat exchanger 110 according to the present embodiment are formed by cutting and raising parts of the plate-shaped part 160, as in the aforedescribed first embodiment, and are thereby formed integrally with the plate-shaped part 160. The third louvers 162 therefore need not be formed on the plate-shaped part 160 using separate members, and the fins 150 that include the third louvers 162 can be easily formed using dies or the like.

(2-5)

The heat exchanger 110 according to the present embodiment is used in the outdoor unit of an air-conditioning device that can perform defrosting operations for removing frost that has formed on the heat exchanger 110, as in the aforedescribed first embodiment. The defrosting operations thereby cause the frost to melt to form water droplets. The water droplets do not remain between the adjoining third louvers 162 even when in contact with the louvers, due to the arrangement of the plurality of the third louvers 162 that have a folded shape. The heat-transfer efficiency of the heat exchanger 10 can therefore be prevented from decreasing.

(3) Modifications (3-1) Modification A

The louvers 161 according to the present embodiment may further have the first louvers 62 and the second louvers 63 in addition to the third louvers 162. For example, approximately five instances of the combination of the first louver 62 and the second louver 63 may be arranged on one of the plate-shaped parts 60 on the upstream side in the air-flow direction, after which a plurality of the third louvers can be arranged. These arrangements may be set as appropriate in consideration of the ease with which frost adheres, the flow volume of air, and other factors.

(3-2) Modification B

The third louvers 162 may be formed on one surface of the plate-shaped part 60 or may be formed on one portion of the plate-shaped part 60, as for the first louvers 62 and the second louvers 63 according to the aforedescribed first embodiment.

(3-3) Modification C

The number of the third louvers 162 arranged may or may not be the same for each of the plate-shaped parts 160 in the wave-shaped fins 150, as for the first louvers 62 and the second louvers 63 according to the aforedescribed first embodiment.

(3-4) Modification D

The fins that are positioned between the flat heat-transfer tubes 141, 142, 143 . . . are described in terms of the first fin 151 and the second fin 152 in the present embodiment. However, the fins according to the present invention need not be positioned between the flat heat-transfer tubes; third louvers 162 according to the aforedescribed present embodiment can be formed even on the fins on portions contacting any of the flat heat-transfer tubes.

(3-5) Modification E

The heat exchanger 110 according to the present embodiment can also be applied as the heat exchanger in the outdoor unit of a refrigeration device other than an air-conditioning device, such as the heat-source unit of a hot-water-supplying device or the like, as for the heat exchanger 10 according to the aforedescribed first embodiment.

The heat exchanger 110 according to the present embodiment can also be used at a minimum as an evaporator for refrigerant instead of functioning as an evaporator or radiator for refrigerant.

(3-6) Modification F

A case is also described in the present embodiment in which the heat exchanger 110 is a so-called layered microchannel heat exchanger, as for the aforedescribed first embodiment. However, as long as a configuration is employed in which the inclination angle of the distal portions with respect to the plate-shaped part is different from that of the plate-shape-side portion, any type of heat exchanger can be used. Other types of heat exchanger include heat exchanger types in which flat heat-transfer tubes are inserted into insertion tubes provided to plate-shaped fins, heat exchanger types in which heat-transfer tubes having circular cross-sections are inserted into the fins, heat exchangers in which a plurality of fins are positioned on one portion of the flat heat-transfer tubes, and the like.

INDUSTRIAL APPLICABILITY

The heat exchanger according to the present invention allows water droplets to be prevented from accumulating between louvers and causes water drainage between the louvers to be improved. The heat exchanger according to the present invention can be mounted in outdoor units, heat-source units, and other units disposed outdoors in refrigerating devices capable of performing defrosting operations.

What is claimed is:

1. An air-cooled and ventilated heat exchanger, comprising:

a fin having a plate-shaped part and a plurality of protruding parts, the plate-shaped part being positioned so that a plate-thickness direction intersects an air-flow direction generated by ventilation, and the protruding parts protruding from the plate-shaped part in the plate-thickness direction; and a plurality of heat-transfer tubes inserted into the fin so as to intersect the air-flow direction, the plurality of the protruding parts having a plurality of first protruding parts and a plurality of second protruding parts, with an inclination angle of each of the first protruding parts with respect to the plate-shaped part being a first angle, an inclination angle of each of the second protruding parts with respect to the plate-shaped part being a second angle, the second protruding parts being placed adjacent to the first protruding parts in an individually alternating manner such that at least one first protruding part is disposed adjacent second protruding parts on opposite sides thereof relative to the airflow direction and at least one second protruding part is disposed adjacent first protruding parts on opposite sides thereof relative to the airflow direction, an inclination direction of the first protruding parts and an inclination direction of the second protruding parts are the same on the same surface of the plate-shaped part, the second angle being larger than the first angle, and spacing between free ends of adjacent alternating first and second protruding parts being approximately equal.

2. The air-cooled and ventilated heat exchanger according to claim 1, wherein the protruding parts are formed by cutting and raising a part of the plate-shaped part.

3. The air-cooled and ventilated heat exchanger according to claim 1, wherein the heat exchanger is used in a refrigerating device operable to perform a defrosting operation in order to remove frost formed on the heat exchanger.

4. The air-cooled and ventilated heat exchanger according to claim 2, wherein the heat exchanger is used in a refrigerating device operable to perform a defrosting operation in order to remove frost formed on the heat exchanger.

* * * * *